US006053233A

United States Patent [19]

Lin

[11] Patent Number: 6,053,233

[45] Date of Patent: Apr. 25, 2000

[54] STRUCTURE OF AUTOMATIC TAPE CUTTER/STICKER

[76] Inventor: Shuh-Chin Lin, 1F., No. 36, Lane 13, Chi-Hsiang St., Hsintien City, Taipei County, Taiwan

[21] Appl. No.: 09/120,317

[22] Filed: Jul. 22, 1998

[51] Int. Cl.[7] ..... B32B 31/00

[52] U.S. Cl. ..... 156/523; 156/574; 156/577; 156/579; 242/588.6

[58] Field of Search ..... 156/523, 577, 156/574, 579; 242/588.6

[56] References Cited

U.S. PATENT DOCUMENTS 4,097,328 6/1978 Urushizaki ..... 156/523
4,792,375 12/1988 Lin ..... 156/510

*Primary Examiner*—Richard Crispino
*Assistant Examiner*—Linda L. Gray
*Attorney, Agent, or Firm*—Rosenberg, Klein & Lee

[57] ABSTRACT

An automatic tape cutter/sticker includes a bottom shell body, a main shell body pivoted to the bottom shell body and turned in and out of a side opening on the bottom shell body, the main shell body having an annular tube, which holds an adhesive tape, and an arched spring plate, which is mounted in the annular tube and having two opposite ends extended out of respective slots on the annular tube to hold the adhesive tape in place, a rotary cutter holder with a cutter blade rotated by the main shell body to cut the free end of the adhesive tape, a rotary guard plate rotated by the main shell body in the reverse of the rotary cutter holder to close/open a tape outlet notch slot on the bottom shell body, and a cover plate covered on the bottom shell body, the cover plate having coupling means at one end hinged to one side of the bottom shell body, and hook means at an opposite side for hooking in a hook hole at an opposite side of the bottom shell body.

1 Claim, 5 Drawing Sheets

STRUCTURE OF AUTOMATIC TAPE CUTTER/STICKER

BACKGROUND OF THE INVENTION

The present invention relates to an improved structure of automatic tape cutter/sticker which enables the user to replenish the adhesive tape easily and safely.

FIGS. 8 through 10 shows a structure of automatic tape cutter/sticker according to U.S. Pat. No. 4,792,375, which is issued to the present inventor. This structure of automatic tape cutter/sticker comprises a first shell body 6, a second shell body 7 nested inside the first shell body 6 and turned about an upright pivot means 61, a spring plate 66 connected between the first shell body 6 and the second shell body 7 to impart an outward pressure to the second shell body 7, and a cover 9 covered on the first shell body 6 over the second shell body 7. The second shell body 7 comprises two elongated slot 71 respectively coupled to respective bosses 62 at the first shell body 6 by screws 711 to limit the turning angle of the second shell body 7 relative to the first shell body 6, and an annular tube 8 formed of arched tube plates 81 at the center to hold an adhesive tape 132. The first shell body 6 comprises a tape outlet notch slot 64 at one side, a rotary cutting knife 65 revolvably supported on the inside adjacent to the tape outlet notch slot 64 and holding a blade 651 for cutting. The second shell body 7 further comprises a driving rod 72, which is moved with the second shell body 7 to rotate the rotary cutting knife 65. The cover 9 has a plurality of downwardly extended coupling tubes 91 at the bottom side. The first shell body 6 comprises a plurality of upstanding lugs 63 respectively fitted into the axial holes 92 of the coupling tubes 91. This structure of automatic tape cutter/sticker still has drawbacks. Because the slots 71 of the second shell body 7 are respectively coupled to the bosses 62 of the first shell body 6 by the respective screws 711, the peripheral edges of the slots 71 tend to be damaged by the screws 711 after long uses. Frequently moving the second shell body 7 relative to the first shell body 6 may cause the screws 711 to vibrate. If the screws 711 are fastened excessively tight, much resisting force is produced during the operation of the automatic tape cutter/sticker, thereby causing the second shell body 7 unable to be smoothly moved relative to the first shell body 6. Still another drawback of this structure of automatic tape cutter/sticker is that the arched tube plates 81 lose their spring power quickly with use, causing the annular tube 8 unable to firmly hold the adhesive tape 132 in place. Still another drawback of this structure of automatic tape cutter/sticker is the difficult blade installation procedure of inserting to the blade 651 into the curved mounting groove 652 on the rotary cutting knife 65. When installing the blade 651 in the curved mounting groove 652, the operator's hand tends to be injured by the blade 651. Furthermore, because the cover 9 and the first shell body 6 are fastened together by plugging the upstanding lugs 63 into the axial holes 92 on the coupling tubes 91, the cover 9 tends to be forced away from the first shell body 6.

SUMMARY OF THE INVENTION

The present invention has been accomplished to provide an improved structure of automatic tape cutter/sticker which eliminates the aforesaid drawbacks. According to the present invention, the automatic tape cutter/sticker comprises a bottom shell body, the bottom shell body comprising a top open chamber, a side opening at one side of the top open chamber, a first upright tube and a second upright tube disposed in the top open chamber at two opposite sides, a tape outlet notch slot in one corner thereof opposite to the side opening, an upright axle inside the top open chamber adjacent to the tape outlet notch slot, a guide rib inwardly extended from an upright side wall thereof at one side of the tape outlet notch slot, an upright shaft at one side adjacent to the first upright tube, and a hook hole inside the top open chamber at one side adjacent to the second upright tube; a cover plate for covering the top open chamber of the bottom shell body, the cover plate comprising coupling means at one end hinged to the upright shaft of the bottom shell body, and hook means at an opposite side for hooking in the hook hole of the bottom shell body to secure the cover plate in a closed position; a main shell body nested inside the top open chamber of the bottom shell body and turned about the first upright tube in and out of the side opening of the bottom shell body, the main shell body comprising a sleeve at one side sleeved onto the first upright tube and secured in place by a pivot bolt, a flat spring plate bent slightly around the sleeve to push the main shell body out of the side opening of the bottom shell body, the flat spring plate having one end fastened to the main shell body and an opposite end fastened to the bottom shell body, an elongated slot disposed at one side remote from the sleeve and coupled to the second upright tube of the bottom shell body to limit the turning angle of the main shell body about the first upright tube of the bottom shell body, an annular tube on the inside at the center holding an adhesive tape, the annular tube comprising as two slots at two opposite sides, an arched spring plate mounted within the annular tube, the arched spring plate having two opposite ends respectively extended out the annular tube through the slots on the annular tube, the two opposite ends of the arched spring plate each having a retaining portion at a top side for holding the adhesive tape in place, a tape roller ramming cylinder disposed in one corner, the tape roller ramming cylinder being moved to carry a free end of the adhesive tape out of the tape outlet notch slot of the bottom shell body for application when the main shell body is depressed and forced into the inside of the top open chamber of the bottom shell body, a guide plate disposed adjacent to the tape roller ramming cylinder for guiding and supporting the free end of the adhesive tape, a first downward rod and a second downward rod downwardly raised from a bottom side wall thereof at two opposite sides relative to the tape roller ramming cylinder;. a rotary guard plate mounted on the upright axle inside the top open chamber of the bottom shell body and rotated by the main shell body to close/open the tape outlet notch slot of the bottom shell body, the rotary guard plate comprising a center hole which receives the upright axle of the bottom shell body and a peripheral notch coupled to the first downward rod of the main shell body; and a cutter holder mounted on the upright axle inside the top open chamber of the bottom shell and carried on the rotary guard plate and rotated by the main shell body in the reverse of the rotary guard plate, the cutter holder comprising a center hole which receives the upright axle of the bottom shell body, a peripheral notch coupled to the second downward rod of the main shell body, an arched slot through which the first downward rod of the main shell body passes, a cutter blade fixedly secured thereto, the cutter blade being moved with the cutter holder to cut the free end of the adhesive tape, and a stop flange stopped above the cutter blade for protection.

DETAILED DESCRIPTION OF THE PREFERRED EMBODIMENT

Figure 1:
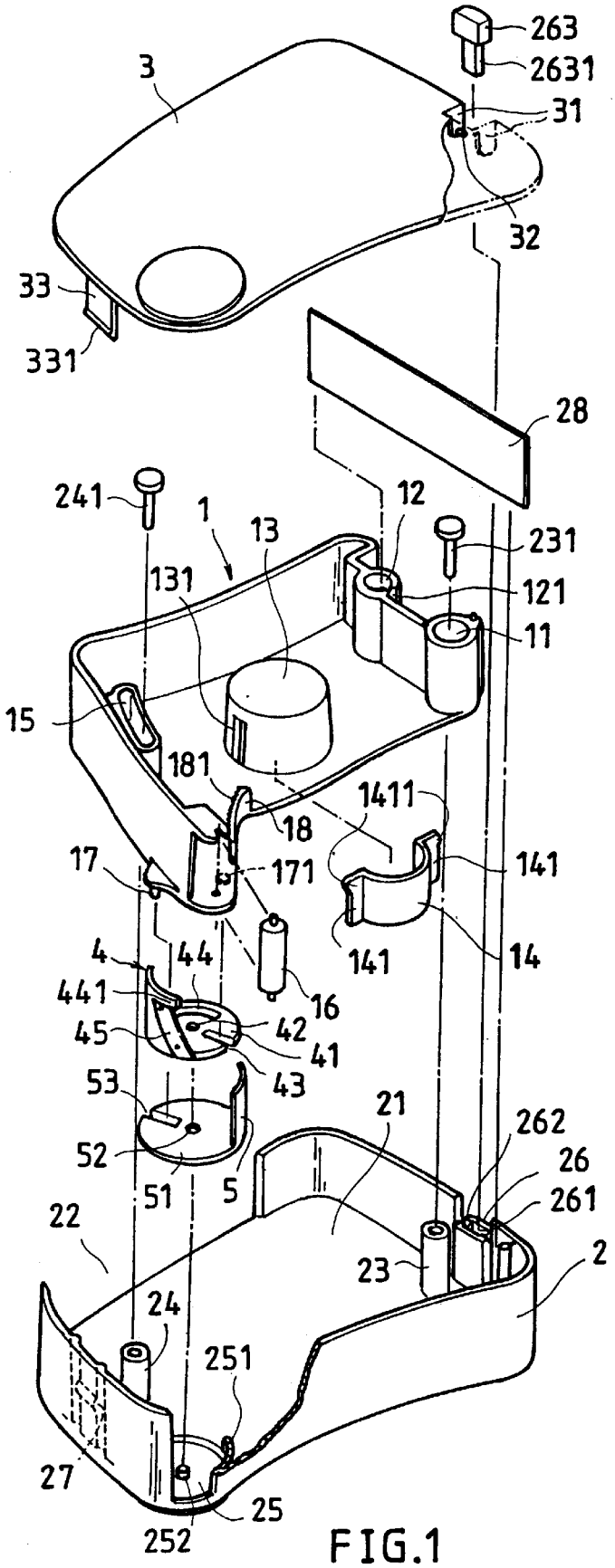
FIG. 1 is an exploded view of an automatic tape cutter/sticker according to the present invention.
Figure 2:
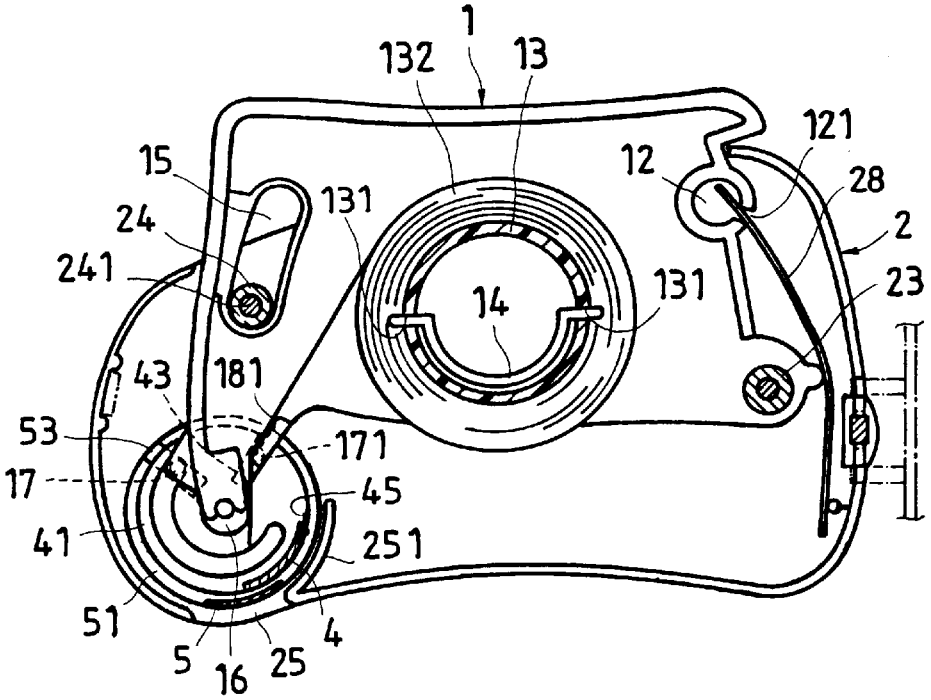
FIG. 2 is a side plain view of the present invention, showing the main shell body extended out of the side opening of the bottom shell body.
Figure 3:
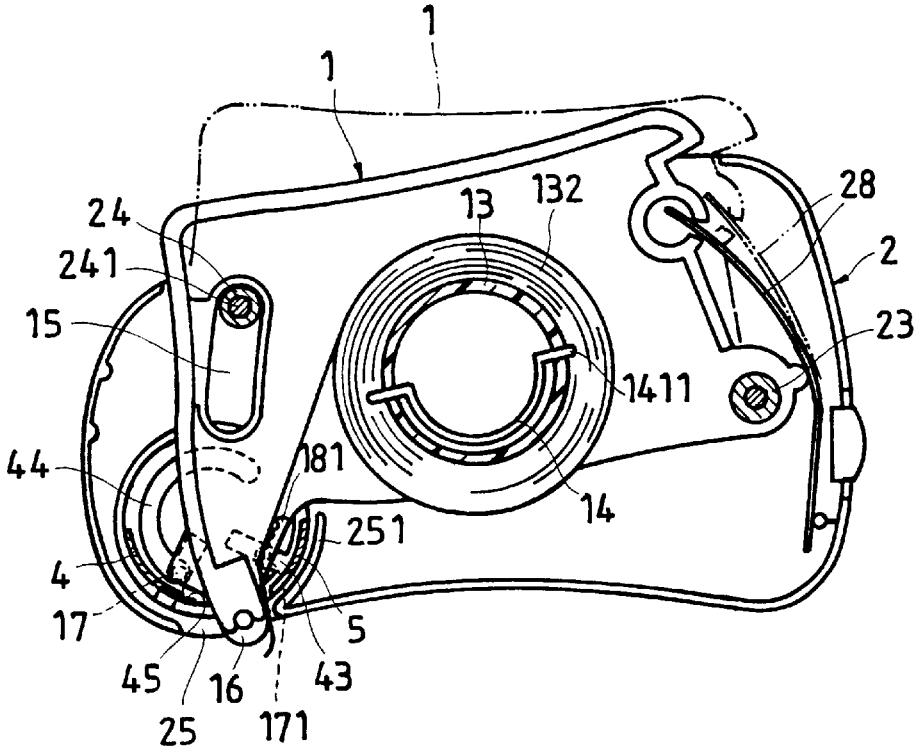
FIG. 3 shows the main shell body depressed, the tape roller ramming cylinder moved out of the tape outlet notch slot according to the present invention.

Referring to FIGS. 1, 2, 3 and 4, the present invention is generally comprised of a main shell body 1, a bottom shell body 2, and a cover plate 3. The main shell body 1 nests inside the bottom shell body 2 with the cover plate 3 being used to cover the main shell body 1 as well as for providing a finished appearance to the automatic tape cutter/sticker. The bottom shell body 2 comprises a first upright tube 23 and a second upright tube 24 disposed in the top open chamber 21 thereof at two opposite sides. The main shell body 1 has a sleeve 11 disposed in one corner and sleeved onto the first upright tube 23. A pivot bolt 231 is fastened to the first upright tube 23 to secure the sleeve 11 to the first upright tube 23, permitting the main shell body 1 to be turned about the first upright tube 23 within the top open chamber 21. A spring plate 28 is bent slightly around the sleeve 11, having one end engaged into a split 121 at one upright tube 12 at one side of the main shell body 1 and an opposite end stopped at an inside wall of the bottom shell body 2. The spring plate 28 is used in the main shell body 1 in an uppermost position as shown in FIG. 2. The spring plate 28 imparts an outward pressure to the main shell body 1, causing the main shell body 1 to partially project out of a side opening 22 of the bottom shell body 2 for operation by hand. An elongated slot 15 is provided at the main shell body 1 at one side remote from the upright tube 12 and the sleeve 11. A bolt 241 is inserted through the elongated slot 15 and engaged into the second upright tube 24 inside the bottom shell body 2 to limit the turning angle of the main shell body 1 about the first upright tube 23. A tape roller ramming cylinder 16 is disposed in one corner inside the main shell body 1. A tape outlet notch slot 25 is provided in one corner of the bottom shell body 2 corresponding to the tape roller ramming cylinder 16. When the main shell body 1 is depressed by the user, the tape roller ramming cylinder 16 is moved to carry the free end of the tape 132 out of the tape outlet notch slot 25 for application. An upright axle 252 is provided inside the bottom shell body 2 adjacent to the tape outlet notch slot 25 to hold a rotary guard plate 5 and a rotary cutter holder 4 on the rotary guard plate 5. The cutter holder 4 holds a cutter blade 45. The rotary guard plate 5 and the rotary cutter holder 4 each have a base plate 51,41, a center axle hole 52,42 at the center of the base plate 51,41, and a radial notch 53,43 extended to the periphery. The upright axle 252 is inserted through the center axle holes 52,42. The main shell body 1 comprises two downward rods 17,171 downwardly raised from the bottom side wall thereof at two opposite sides relative to the tape roller ramming cylinder 16. One downward rod 17 is inserted into the radial notch 43 on the rotary cutter holder 4. The other downward rod 171 is inserted through an arched slot 44 on the rotary cutter holder 4 into the radial notch 53 on the rotary guard plate 5. When the main shell body 1 is turned about the first upright tube 23, the rotary cutter holder 4 and the rotary guard plate 5 are rotated in reversed directions. When the main shell body 1 is depressed by the operator, the rotary guard plate 5 is rotated in one direction to open the tape outlet notch slot 25, the rotary cutter blade 4 is rotated in the reversed direction to move the cutter blade 45 away from the cutting position, and at the same time, the tape roller ramming cylinder 16 is moved out of the tape outlet notch slot 25 for applying the tape 132 (see FIG. 3). When the main shell body 1 is released, it is automatically pushed back to its former position, as shown in FIG. 2, at the same time, the rotary cutter blade 45 and the rotary guard plate 5 are rotated in the reversed directions, causing the free end of the tape 132 to be cut, and the tape outlet notch slot 25 is closed by the rotary guard plate 5 again (see FIG. 2). Further, a guide plate 18 is provided at the main shell body 1 adjacent to the tape roller ramming cylinder 16, having a guide face 181 for guiding and supporting the free end of the tape 132.

Figure 4:
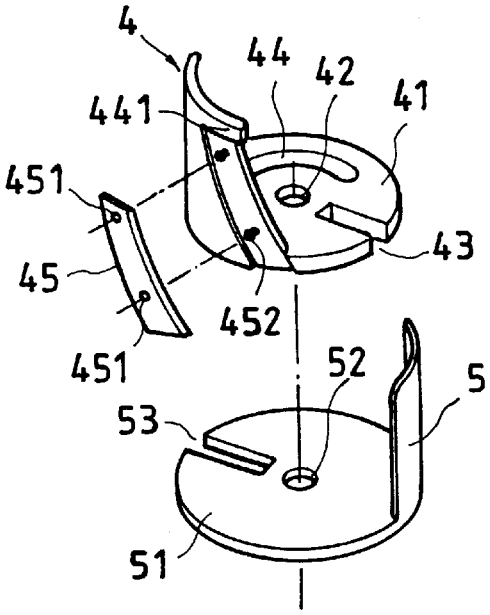
FIG. 4 is an exploded view of the rotary guard plate and the rotary cutter holder according to the present invention.
Figure 5:
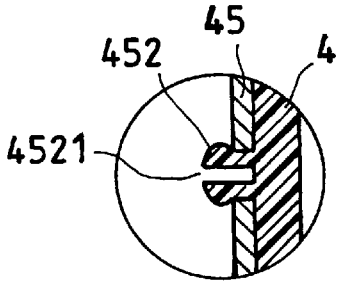
FIG. 5 is a sectional view of a part of the rotary cutter holder according to the present invention.
Figure 8:
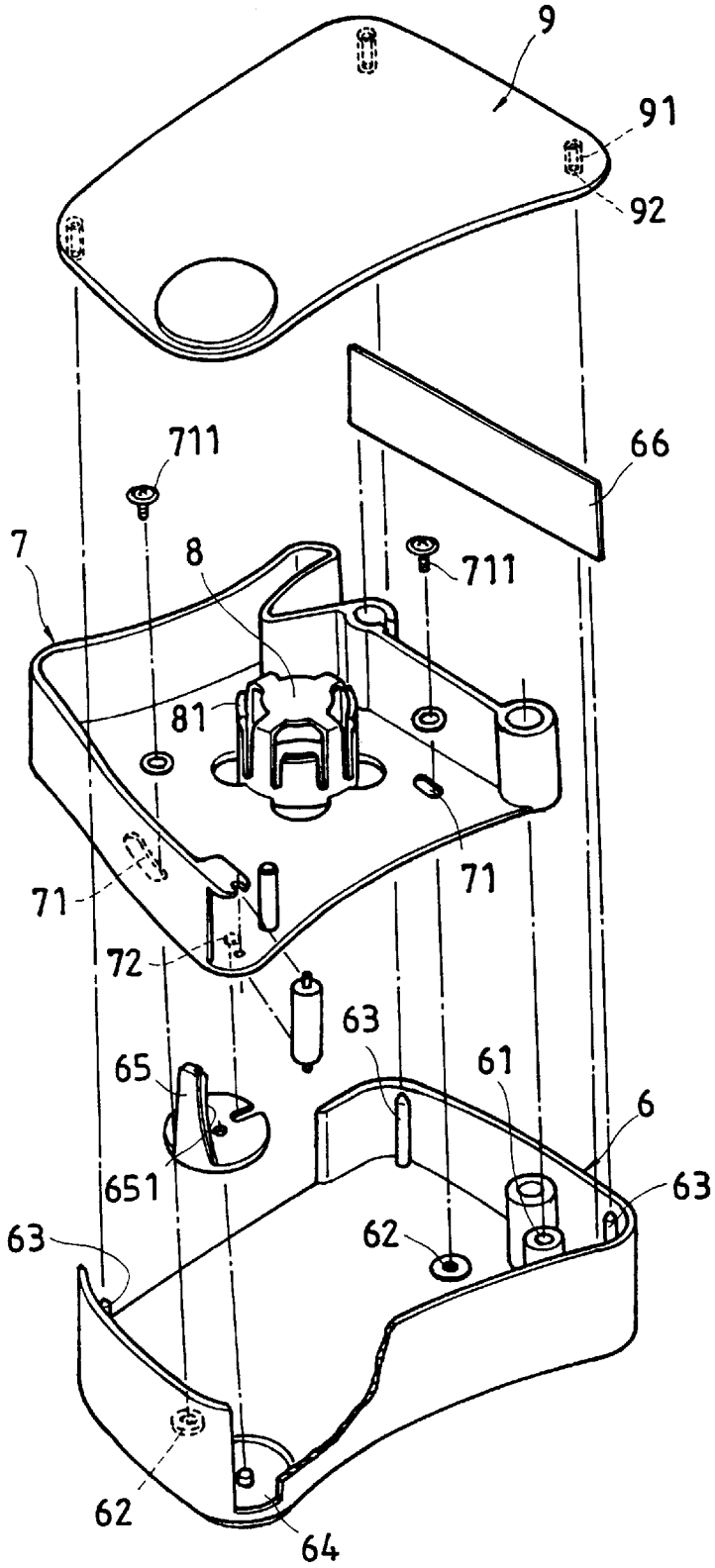
FIG.8 PRIOR ART
FIG. 8 is an exploded view of an automatic tape cutter/sticker according to the prior art.
Figure 9:
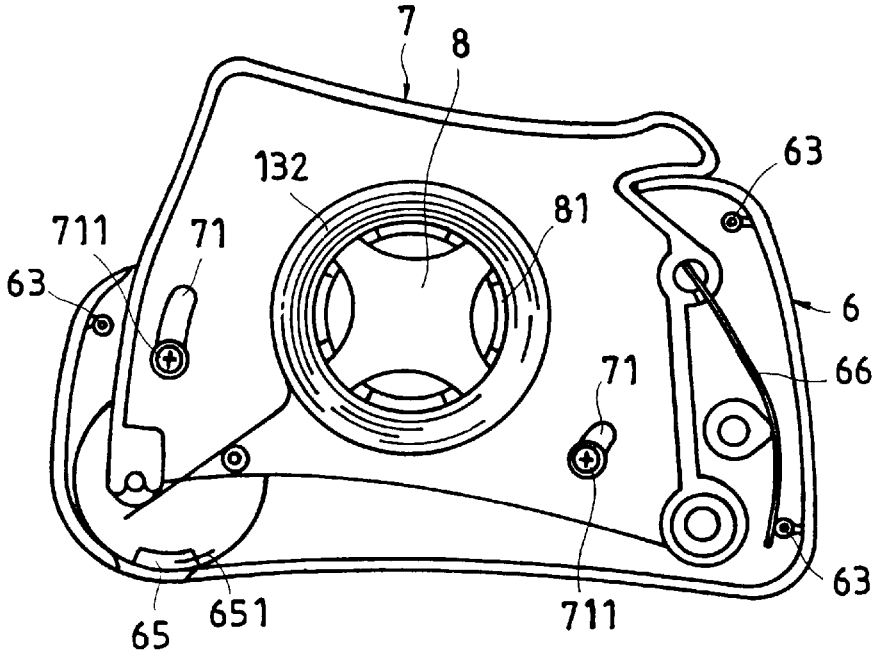
FIG.9 PRIOR ART
FIG. 9 is a side view of the automatic tape cutter/sticker shown in FIG. 8.
Figure 10:
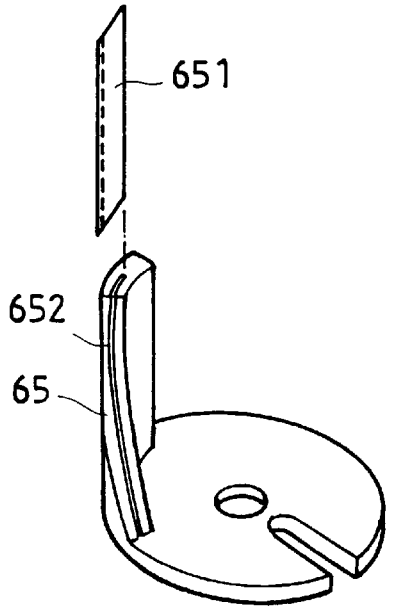
FIG.10 PRIOR ART
FIG. 10 is an exploded view of the rotary cutting knife of the automatic tape cutter/sticker shown in FIG. 8.

Referring to FIGS. 4 and 5, the cutter holder 4 comprises two split bolts 452 for holding the cutter blade 45. The split bolts 452 each have a longitudinal split 4521. The cutter blade 45 has two mounting holes 451 respectively forced into engagement with the split bolts 452 of the cutter holder 4. The cutter holder 4 further comprises a stop flange 441 stopped above the cutter blade 45 for protection.

Figure 6:
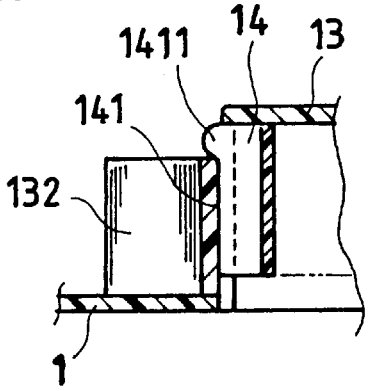
FIG. 6 is a sectional view in an enlarged scale of a part of the present invention, showing the tape secured to the annular tube, the retaining portion of one end of the arched spring plate stopped above the tape.

Referring to FIGS. 1, 2 and 6, the main shell body 1 comprises an annular tube 13 for holding the tape 132. The annular tube 13 has two slots 131 at two opposite sides. An arched spring plate 14 is mounted within the annular tube 13, having two opposite ends 141 respectively extended out the annular tube 13 through the slots 131. The arched spring plate 14 has a retaining portion 1411 raised from each end 141 at the top for holding the tape 132 in place.

Figure 7:
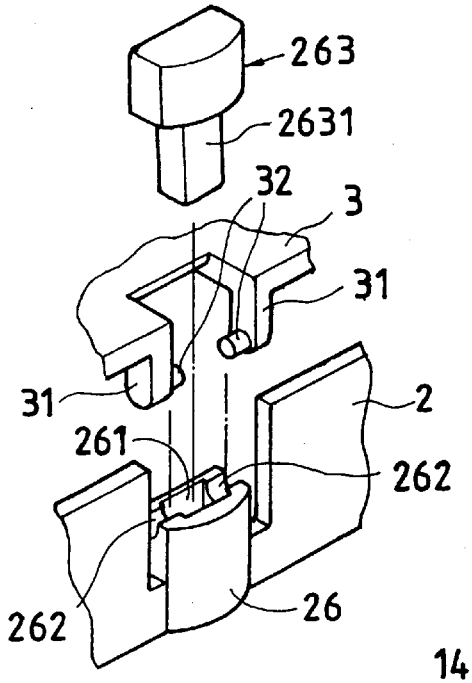
FIG. 7 is an exploded view in an enlarged scale of a part of the present invention, showing the coupling between the cover plate and the bottom shell body.

Referring to FIGS. 1 and 7, the bottom shell body 2 comprises an upright shaft 26 at one side adjacent to the first upright tube 23. The upright shaft 26 comprises an axial plug hole 261, and two recessed bearing portions 262 horizontally aligned at the topmost edge thereof at two opposite sides of the plug hole 261. The cover plate 3 comprises two downward lugs 31 at one end, and two pivot pins 32 respectively raised from the downward lugs 31 and facing each other. A locating member 263 is provided having a plug rod 2631 plugged into the plug hole 261 on the upright shaft 26. When the locating member 263 is installed in the plug hole 261 on the upright shaft 26, the pivot pins 32 are retained to the recessed bearing portions 262, enabling the cover plate 3 to be secured to the bottom shell body 2 and turned about an axis. The cover plate 3 further comprises a downward rod 33 at one side remote from the lugs 31. The downward rod 33 has a hooked bottom end 331 hooked in a hook hole 27 on the inside of the bottom shell body 2. Further more, a rib 251 is inwardly extended from an upright side wall thereof at one side of the tape outlet notch slot 25 for guiding out the free end of the tape 132 (see FIGS. 1, 2 and 3).

While only one embodiment of the present invention has been shown and described, it will be understood that various modifications and changes could be made thereunto without departing from the spirit and scope of the invention disclosed.

What the invention claimed is:

1. An automatic tape cutter/sticker, comprising:

a bottom shell body, said bottom shell body comprising a top open chamber, a side opening at one side of said top open chamber, a first upright tube and a second upright tube disposed in said top open chamber at two opposite sides, a tape outlet notch slot in one corner thereof opposite to said side opening, an upright axle inside said top open chamber adjacent to said tape outlet notch slot, a guide rib inwardly extended from an upright side wall thereof at one side of said tape outlet notch slot, an upright shaft at one side adjacent to said first upright tube, and a hook hole inside said top open chamber at one side adjacent to said second upright tube;

a cover plate for covering the top open chamber of said bottom shell body, said cover plate comprising coupling means at one end hinged to the upright shaft of said bottom shell body, and hook means at an opposite side for hooking in the hook hole of said bottom shell body to secure said cover plate in a closed position;

a main shell body nested inside said top open chamber of said bottom shell body and turned about said first upright tube in and out of said side opening of said bottom shell body, said main shell body comprising a sleeve at one side sleeved onto said first upright tube and secured in place by a pivot bolt, a flat spring plate bent slightly around said sleeve to push said main shell body out of the side opening of said bottom shell body, said flat spring plate having one end fastened to said main shell body and an opposite end fastened to said bottom shell body, an elongated slot disposed at one side remote from said sleeve and coupled to the second upright tube of said bottom shell body to limit the turning angle of said main shell body about the first upright tube of said bottom shell body, an annular tube on the inside at the center holding an adhesive tape, said annular tube comprising as two slots at two opposite sides, an arched spring plate mounted within said annular tube, said arched spring plate having two opposite ends respectively extended out said annular tube through the slots on said annular tube, the two opposite ends of said arched spring plate each having a retaining portion at a top side for holding said adhesive tape in place, a tape roller ramming cylinder disposed in one corner, said tape roller ramming cylinder being moved to carry a free end of said adhesive tape out of the tape outlet notch slot of said bottom shell body for application when said main shell body is depressed and forced into the inside of said top open chamber of said bottom shell body, a guide plate disposed adjacent to said tape roller ramming cylinder for guiding and supporting the free end of said adhesive tape, a first downward rod and a second downward rod downwardly raised from a bottom side wall thereof at two opposite sides relative to said tape roller ramming cylinder;. a rotary guard plate mounted on the upright axle inside the top open chamber of said bottom shell body and rotated by said main shell body to close/open the tape outlet notch slot of said bottom shell body, said rotary guard plate comprising a center hole which receives the upright axle of said bottom shell body and a peripheral notch coupled to the first downward rod of said main shell body; and a cutter holder mounted on the upright axle inside the top open chamber of said bottom shell and carried on said rotary guard plate and rotated by said main shell body in the reverse of said rotary guard plate, said cutter holder comprising a center hole which receives the upright axle of said bottom shell body, a peripheral notch coupled to the second downward rod of said main shell body, an arched slot through which the first downward rod of said main shell body passes, two split bolts at different elevations, a stop flange spaced above said split bolts, and a cutter blade fixedly to said split bolts and stopped below said stop flange and moved with said cutter holder to cut the free end of said adhesive tape, said cutter blade having two coupling holes respectively forced into engagement with said split bolts.

* * * * *